US010080077B2

(12) United States Patent
Silvestri

(10) Patent No.: US 10,080,077 B2
(45) Date of Patent: Sep. 18, 2018

(54) EAR CUSHION FOR HEADPHONE

(71) Applicant: Bose Corporation, Framingham, MA (US)

(72) Inventor: Ryan Silvestri, Franklin, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/019,325

(22) Filed: Feb. 9, 2016

(65) Prior Publication Data

US 2017/0230746 A1 Aug. 10, 2017

(51) Int. Cl.

*H04R 25/00* (2006.01)
*H04R 1/10* (2006.01)
*H04R 31/00* (2006.01)

(52) U.S. Cl.

CPC ..... *H04R 1/1083* (2013.01); *H04R 31/00* (2013.01)

(58) Field of Classification Search

CPC ..... H04R 1/1083; H04R 31/00
See application file for complete search history.

(56) References Cited

U.S. PATENT DOCUMENTS 3,479,669 A 11/1969 Allen
4,260,575 A 4/1981 Thew et al.
4,856,118 A 8/1989 Sapiejewski
2006/0037809 A1* 2/2006 Fuller ..... F16F 1/361 181/207
2011/0007928 A1 1/2011 Chang
2013/0087404 A1 4/2013 Peskar et al.
2016/0171962 A1* 6/2016 Jenkins ..... H04R 1/1083 381/71.6

FOREIGN PATENT DOCUMENTS

DE 3210034 A1 9/1982
EP 1727390 A2 11/2006
GB 2394166 A 4/2004
GB 2527157 A 12/2015
WO 9948325 A1 9/1999

OTHER PUBLICATIONS

Bechwati, et al., "Adsorption in activated carbon and its effects on the low frequency performance of hearing defenders", Acoustics 08 Paris, Jun. 29-Jul. 4, 2008, Paris; 6 pages.
International Search Report and Written Opinion in counterpart International Patent Application No. PCT/US17/15310, dated May 2, 2017; 15 pages.

* cited by examiner

*Primary Examiner* — Tuan D Nguyen
(74) *Attorney, Agent, or Firm* — Schmeiser, Olsen & Watts LLP

(57) ABSTRACT

A headphone comprises at least one cushion constructed and arranged for contact with a wearer, the at least one cushion comprising an interior region; an electro-acoustical driver that transmits a sound towards an ear canal of the wearer of the headphone; and a plurality of segments comprising a sound absorbing material that at least partially fill the interior region of the cushion.

20 Claims, 4 Drawing Sheets

EAR CUSHION FOR HEADPHONE

BACKGROUND

This description relates generally to headphones, and more specifically, to headphone cushion configurations.

BRIEF SUMMARY

In accordance with one aspect, a headphone comprises at least one cushion constructed and arranged for contact with a wearer, the at least one cushion comprising an interior region; an electro-acoustical driver that transmits a sound towards an ear canal of a wearer of the headphone; and a plurality of segments comprising a sound absorbing material that at least partially fill the interior region of the cushion.

Aspects may include one or more of the following features:

The sound absorbing segments may be at least one of: cube, sphere, or rectangular shaped.

The sound absorbing material may comprise a foam material.

The foam material may comprise a partially reticulated foam structure.

The foam material may comprise polyurethane.

The headphone may further comprise a cushion covering constructed and arranged for covering the interior region of the cushion, and for maintaining the segments in the interior region.

The interior region may include a passageway in front of the electro-acoustical driver and surrounded by an arrangement of the segments so as to form an acoustical path from the driver to the ear canal when the headphone is worn.

The segments may provide greater acoustic damping over a range of frequencies when compared to a reference single piece of sound absorbing material filling the cushion.

The segments may provide greater mechanical compliance when compared to the reference single piece of sound absorbing material.

A packing factor of the segments may be less than that of the reference single piece of sound absorbing material.

A ratio of an aggregate of the segments' surface area relative to a volume of the aggregate of the segments in the cushion may be increased compared to the same ratio in the cushion including the reference single piece of sound absorbing material.

The headphone may further comprise an ear cup coupled to the cushion, the driver may be positioned between the ear cup and the cushion.

In accordance with another aspect, a headphone comprises a first earpiece unit and a second earpiece unit. Each of the first and second earpiece units comprises: a cushion constructed and arranged for contact with a wearer, the at least one cushion comprising an interior region; an electro-acoustical driver that transmits a sound towards an ear canal of the wearer of the headphone; and a plurality of segments comprising a sound absorbing material that at least partially fill the interior region of the cushion. A connector extends between the first and second earpiece units.

Aspects may include one or more of the following features:

The sound absorbing segments may be at least one of: cube, sphere, or rectangular shaped.

The sound absorbing material may comprise a foam material.

The foam material may comprise a partially reticulated foam structure.

The foam material may comprise polyurethane.

The headphone may further comprise a cushion covering constructed and arranged for covering the interior region of the cushion, and for maintaining the segments in the interior region.

The interior region may include a passageway in front of the electro-acoustical driver and surrounded by an arrangement of the segments so as to form an acoustical path from the driver to the ear canal when the headphone is worn.

The segments may provide greater acoustic damping over a range of frequencies when compared to a reference single piece of sound absorbing material filling the cushion.

The segments may provide greater mechanical compliance when compared to the reference single piece of sound absorbing material.

A packing factor of the segments may be less than that of the reference single piece of sound absorbing material.

A ratio of an aggregate of the segments' surface area relative to a volume of the aggregate of the segments in the cushion may be increased compared to the same ratio in the cushion including the reference single piece of sound absorbing material.

The headphone may further comprise an ear cup coupled to the cushion, the driver may be positioned between the ear cup and the cushion.

In accordance with another aspect, an earpiece unit comprises an ear cup; a cushion coupled to the ear cup, and constructed and arranged for contact with a wearer; a plurality of segments comprising a sound absorbing material that at least partially fill the interior region of the cushion skin; and an electro-acoustical driver between the ear cup and the cushion, the driver transmitting a sound towards an ear canal of the wearer of the headphone.

Aspects may include one or more of the following features:

The sound absorbing segments may be at least one of: cube, sphere, or rectangular shaped.

The sound absorbing material may comprise a foam material.

The interior region may include a passageway in front of the electro-acoustical driver and surrounded by an arrangement of the segments so as to form an acoustical path from the driver to the ear canal when the headphone is worn.

The segments may provide greater acoustic damping over a range of frequencies when compared to a reference single piece of sound absorbing material filling the cushion.

The segments may provide greater mechanical compliance when compared to the reference single piece of sound absorbing material.

A packing factor of the segments may be less than that of the reference single piece of sound absorbing material.

A ratio of an aggregate of the segments' surface area relative to a volume of the aggregate of the segments in the cushion may be increased compared to the same ratio in the cushion including the reference single piece of sound absorbing material.

The headphone may further comprise an ear cup coupled to the cushion, the driver may be positioned between the ear cup and the cushion.

In accordance with another aspect, a method of forming a headphone comprises providing a cushion skin having an interior region; at least partially filling the cushion skin with a plurality of segments comprising a sound absorbing material; forming an opening in the interior region surrounded by the segments; and positioning the cushion skin and the segments about an electro-acoustical driver so that the driver transmits a sound through the opening towards an ear canal of a wearer of the headphone.

BRIEF DESCRIPTION

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Headphone ear cushions are typically formed by cutting a 2-D stamped sheet or block of foam into a rectangular shape and inserting it into an ear cup. In order to construct the ear cushion for positioning about a headphone speaker, the corners and center region of the foam material are cut from the foam block and discarded. However, cushion compliance, comfort level, and acoustic quality are constrained by such a construction, not to mention the waste produced by the undesirable excess pieces of foam removed from the block to form the desired shape. Also, manufacturing inefficiencies may arise when assembling headphones, in particular, inserting a foam block having a rectangular cross-section into a round skin of a typical ear cushion.

Examples of the present inventive concepts relate to an around ear or on ear headphone that includes one or two ear cushions, each comprising a plurality of sound absorbing segments placed together in a region of the headphone between an electro-acoustical driver such as a speaker and the outer surface of the headphone. An earpiece cushion comprising a plurality of sound absorbing foam segments eliminates waste, since all foam segments may be implemented as part of a headphone construction, as distinguished from foam pieces discarded when forming an ear cushion from a single block or sheet of foam material. An earpiece cushion comprising a plurality of foam segments also allows the ear cushion to form a shape suitable for the headphone, for example, a round shape, when inserted in the ear cup of the headphone, while also providing improved comfort when abutting the wearer's head. Also, the implementation of foam segments allows the earpiece cushion to be more compliant (and thus more comfortable) than an equivalent volume of foam in a conventional rectangular foam block formed for insertion in a round skin of an ear cup. In a cushion formed from foam segments, the ratio of the foam's surface area relative to the volume of the foam is increased when compared to that same ratio in an ear cushion formed from a single block of foam material. Using a plurality of foam segments enables flexibility in tuning a number of design parameters to achieve a desired acoustic performance in the headphone. For example, the size and shape of the foam, type of foam, density of foam, foam fill percentage, and other characteristics may be tuned to achieve a desired cushion compliance, passive attenuation and damping as compared to a single piece construction. Moreover, the formation of an earpiece cushion from foam segments increases the acoustic damping per volume of foam, which permits the use of less foam in order to achieve a similar level of damping, or to use a same amount of foam from the collection of foam segments as in a single foam piece, while achieving improved damping characteristics.

Figure 1:
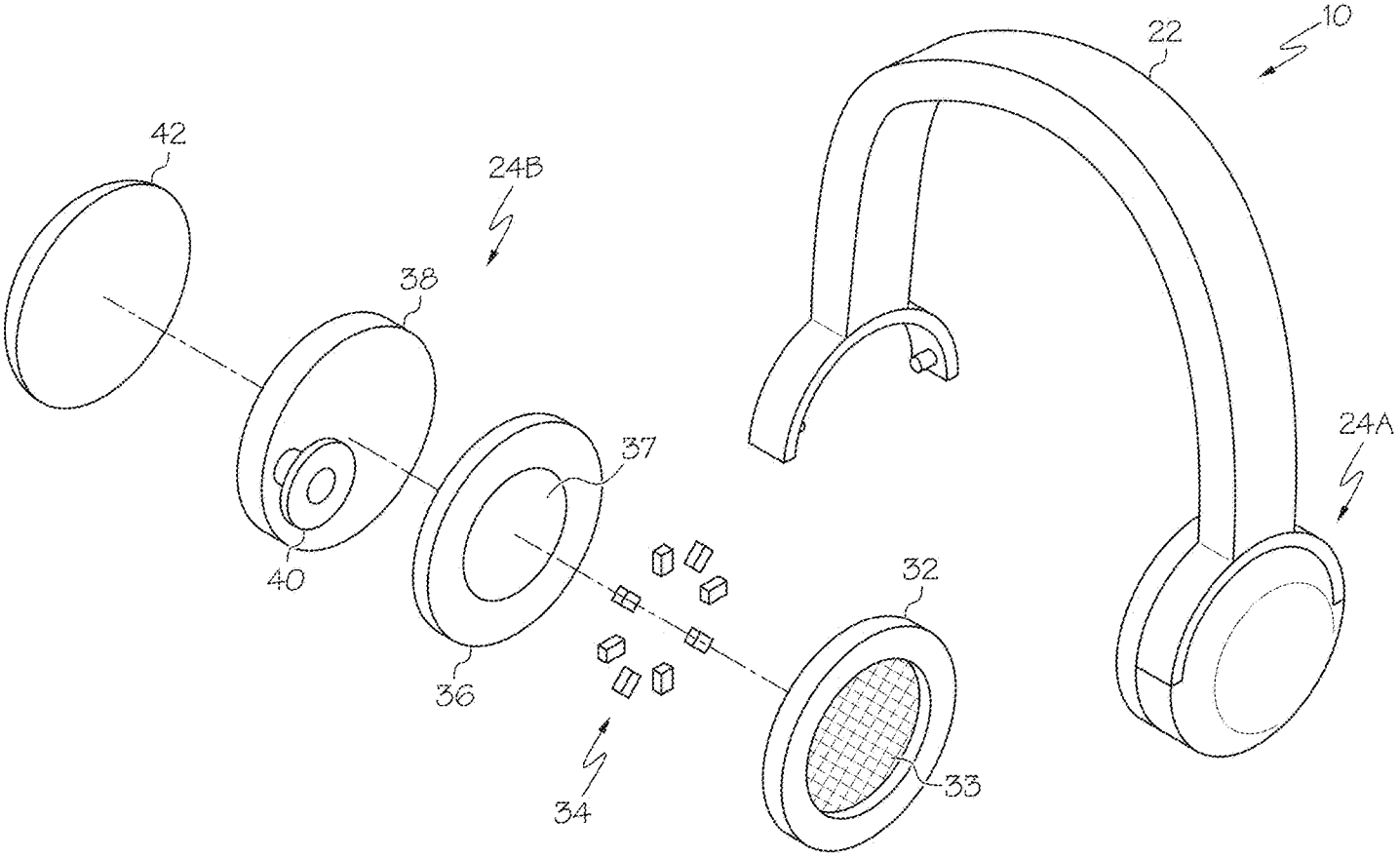
FIG. 1 is an exploded view of a headphone, in accordance with some examples.

FIG. 1 is an exploded view of a headphone 10, in accordance with some examples. The headphone 10 may include an ergonomic headband 22 and two earpiece units 24, each mounted at an end of the headband 22 and positioned at or over a human ear by the headband 22. In some examples, the headphone 10 is an on-ear headphone. In other examples, the headphone 10 is an around ear headphone. Although not shown, the headphone 10 can include and not be limited to other components such as an audio input jack, microphone, adapter, cable, active noise cancellation circuitry, and so on. The headphone 10 can have an open back, a closed back, or a semi-open configuration, and is therefore not limited to the configuration illustrated in FIG. 1.

An earpiece unit 24 can have a circular, ovular, ellipsoid, or other shapes when viewed in cross-section, and can be positioned on or about the ear, for example, providing a seal against the head or ear to attenuate external noise. Each earpiece unit 24 includes a hard outer cover 42 (also referred to as an ear cup), and a soft portion referred to as a cushion, which is coupled to the ear cup 42. The cushion may include a pleather portion, or cushion skin 32, and a plurality of sound absorbing foam segments 34 inside the cushion skin 32. The earpiece unit 24 may also include an optional cushion covering 36 having an opening 37 and a speaker holder 38 in which an electro-acoustical driver 40 such as a speaker is positioned. The cushion skin 32 may include an inner cover opening 33. An acoustic resistance material or scrim material may cover the inner cover opening 33. An acoustical coupling may be formed between the driver 40 and the foam segments 34 in the cushion skin 32.

The ear cup 42 is attached to the back side of the speaker holder 38. The cushion covering 36 may be attached to the front side of the speaker holder 38 and prevent the sound absorbing foam segments 34 from direct contact with circuitry or other components of the speaker holder 38. Some or all of the sound absorbing segments 34 may be attached to the cushion covering 36 and/or interior wall of the cushion skin 32. Alternatively, the segments 34 may be positioned between the cushion covering 36 and the cushion skin 32, which serves as a housing for the segments 34. In other examples, some or all of the sound absorbing segments 34 are glued, bonded, or otherwise affixed to each other, in lieu of "free floating" in the interior of the cushion skin 32. For example, an adhesive or the like may be applied to the sound absorbing segments 34, e.g., coating the segments 34 with adhesive, for gluing the segments 34 together. In this manner, the sound absorbing segments 34 may be prevented from shifting, matting, or otherwise changing with respect to the positioning of the segments 34 in the cushion. In other examples, the sound absorbing segments 34 are of assorted sizes and/or shapes. Here, the smaller segments may be glued together, while the larger segments are positioned in the cushion skin 34 with the coupled smaller segments, but are not coupled to each other. For example, the cushion may include a single block of foam material at least partially surrounded by smaller sound absorbing segments 34.

The cushion covering 36 and/or cushion skin 32 may be perforated. The cushion skin 32 may be attached to the ear cup 42, speaker holder 38, and/or cushion covering 36 and surround the segments 34. The cushion comprising the skin 32 and foam segments 34 may also serve as an ear pad, and may be formed of polyurethane or a similar material having air permeability so that sound generated and obtained from a driver of the headphone unit will be radiated through to the user. A headphone unit 24A, 24B can be constructed for circumaural and supra-aural headphones.

Figure 3:
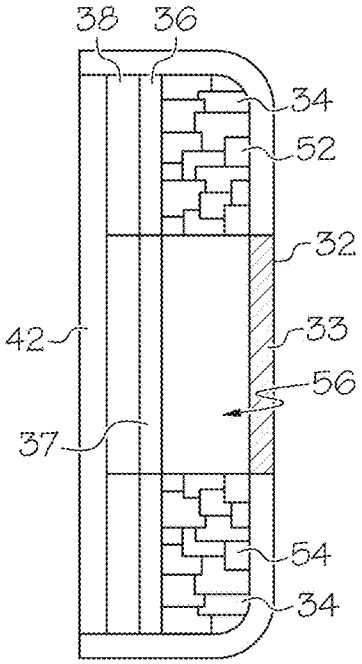
FIG. 3 is a cross-sectional side view of the assembled headphone of FIGS. 1 and 2.

As shown in FIG. 3, the sound absorbing foam segments 34 at least partially fill a region formed between an interior of the cushion skin 32 and a surface of the cushion covering 36 or speaker holder 38. The sound absorbing segments 34 may be various shapes (e.g., cubes, spheres or any other three-dimensional shape), sizes, densities, volumes, materials and/or other parameters. Some or all of the segments 34 may have a same shape, size, density, volume, material and/or other parameter, or may have different shapes, sizes, densities, volumes, materials and/or other parameters. The cushion skin 32 may terminate at the cushion covering 36, and not extend to cover the speaker holder 38 or ear cup 42. The foam segments 34 may be formed of open cell, closed cell, reticulated or partially reticulated foam. The foam segments 34 may be constructed of various types of foam materials, including polyurethane, polyethylene, latex, melamine, and memory foam. Additionally pieces of other materials could be used or mixed with the foam materials to create composite materials such as but not limited to other foams, zeolite, rubber, urethanes, and fabrics.

In some examples, the interior region 56, or sound chamber, of the cushion skin 32 includes a region 52 in which the foam segments 34 may be positioned. For example, the foam segments 34 may be compartmentalized in regions 52 on either side of the unobstructed hole. The sound chamber 56 includes a passageway formed in front of the electro-acoustical driver 40 and formed and surrounded by the arrangement of foam segments 34 so as to form an acoustical path from the driver 40 to the wearer's ear canal when the headphone 10 is worn, and to provide comfort, passive attenuation and acoustic damping. The compartment 52 of foam 34 is acoustically coupled to the volume of the sound chamber 56.

The number of foam segments 34 and/or percentage of a volume of a region 52 filled with foam segments 34 may depend on several factors, including but not limited to comfort, density, foam porosity, cushion compliance, surface area/volume ratio, compression, shape, size, or other properties of the foam materials, and desired acoustic performance. As shown in FIG. 3, a sound chamber 56 extends from the inner cover opening 33 to the driver 40, in particular, when a force is applied to hold the earpiece unit 24 against the wearer's head. The cushion skin 32 and foam segments 34 can rest against the wearer's head on or about the wearer's ear, such that the inner cover opening 33 is substantially aligned with the ear canal of the wearer's ear and for acoustically connecting the internal cavity with the wearer's ear cavity when the cushion rests on the user's ear while being worn.

An improvement with respect to a headphone in some examples relates to a clamping force applied by the headphone against a wearer's head. In particular, due to the increased compliance of the cushion, less clamping force may be required to seal the cushion to a wearer's head, which further improves comfort. Additionally, a higher compliant cushion with the same clamping force will have a more even distribution of pressure on the wearer's head which may provide a more consistent seal and more comfort to the wearer.

Figure 2:
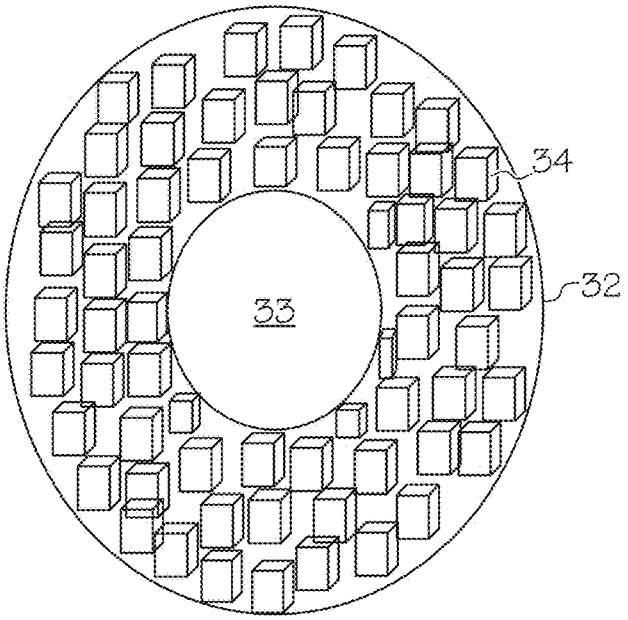
FIG. 2 is a cross-sectional front view of a cushion from the assembled headphone of FIG. 1.
Figure 4:
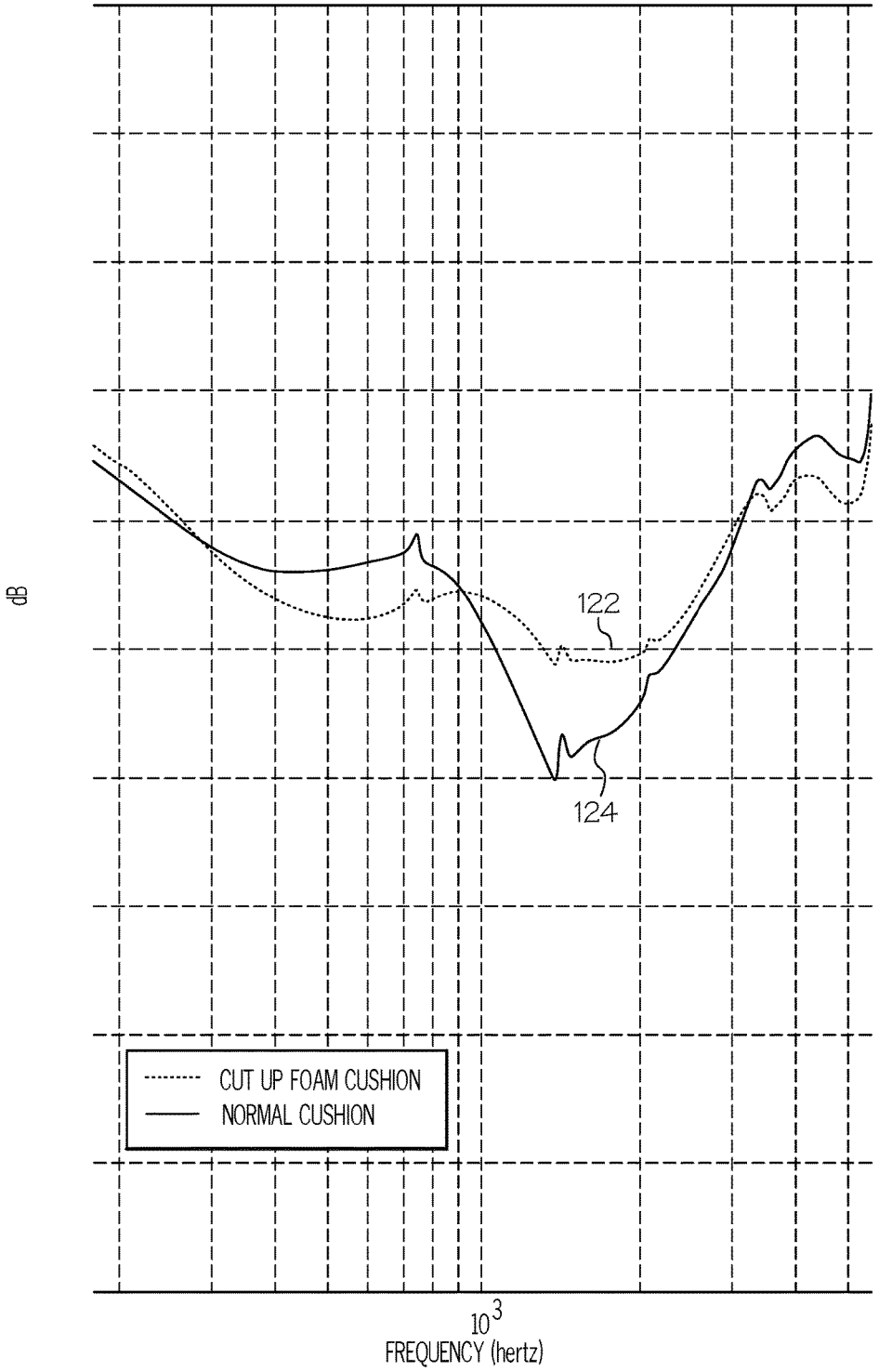
FIG. 4 is a graph illustrating a comparison of an acoustic frequency response of a headphone having a plurality of sound absorbing foam segments in accordance with some examples.

An additional improvement with respect to the first headphone relates to acoustic damping, as illustrated in FIG. 4. FIG. 4 shows frequency response curves 122, 124 corresponding to first and second headphones, respectively. The first headphone has a plurality of sound absorbing foam segments. The second headphone has a single block of foam cushion, for example, having a rectangular shape for insertion into a round headphone skin that encloses the foam cushion. Therefore, in describing the first headphone, reference may be made to the headphone 10 described in FIGS. 1-3. In describing the second headphone, reference may be made to a conventional headphone.

As shown in FIG. 4, the first headphone provides improved damping between 1 and 2 kHz compared to the second headphone. This improved damping was unexpected, as the amount of foam of the cushion had been reduced in the first headphone when compared to the second headphone, for example, 66-75% fill. However, the construction of foam segments in the first headphone provide additional air paths through the foam that are not present in the second headphone. In particular, the air pockets between foam segments provide lower impedance leak paths for air molecules, so the air molecules can better penetrate the foam, which may improve the damping characteristics of the cushion.

Figure 5:
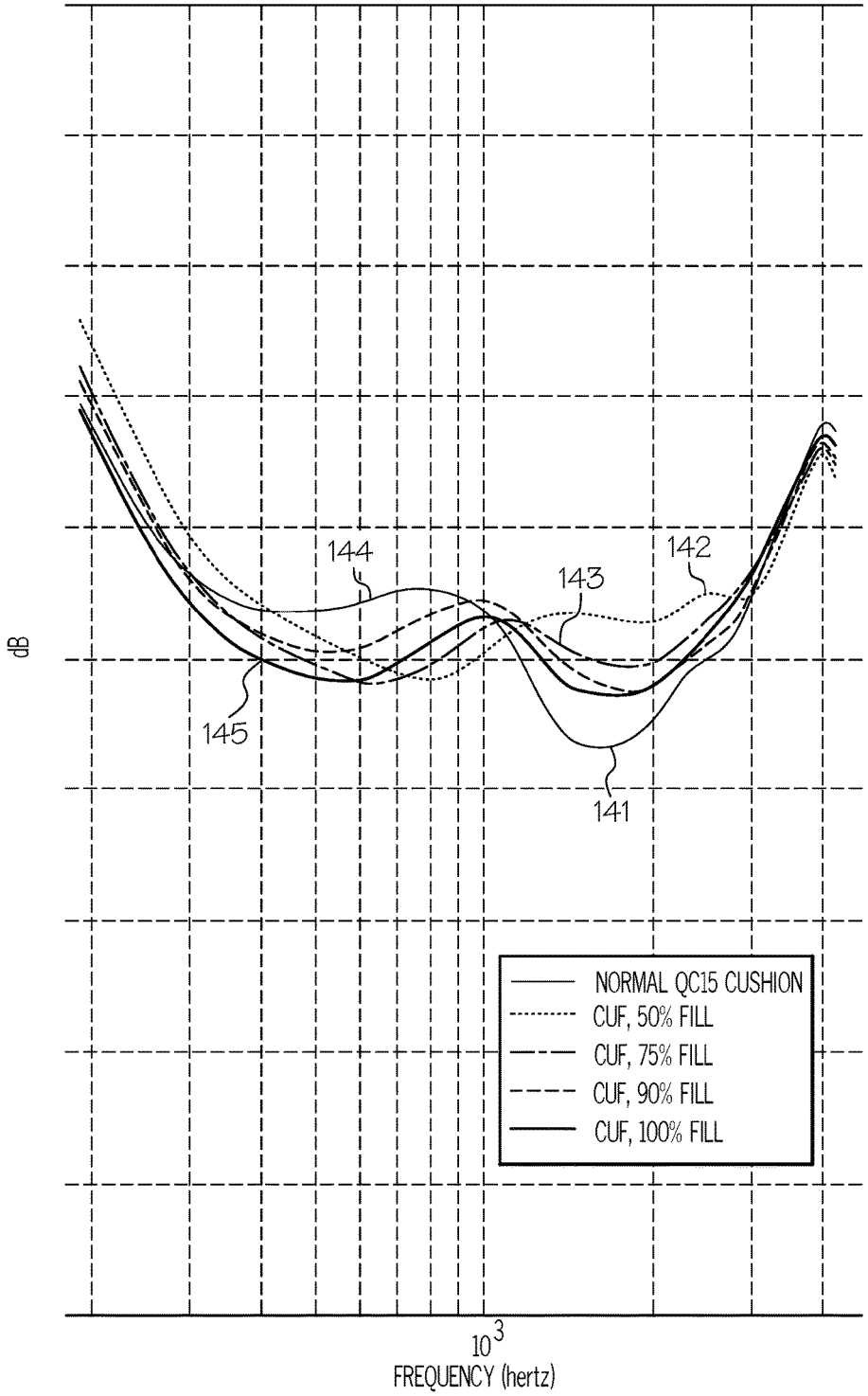
FIG. 5 is a graph illustrating a comparison of frequency responses of headphones, in accordance with some examples.

FIG. 5 is a graph illustrating a comparison of frequency responses of headphones having various percentages of sound absorbing segments filling an ear cup and a conventional headphone having a single block of foam cushion, in accordance with other examples. Frequency response curve 141 corresponding to a conventional headphone including a single block of foam cushion is compared to other frequency response curves 142-145 corresponding to headphones having varying amounts of segment fill (i.e., 50%, 75%, 90% and 100%).

As described herein, cushion compliance and acoustic characteristics can be impacted by the amount of segment fill forming a headphone cushion. Also, as described herein due to the increased compliance of the cushion, less clamping force may be required to seal the cushion to a wearer's head, which further improves comfort. Additionally, a higher compliant cushion with the same clamping force will have a more even distribution of pressure on the wearer's head which may provide a more consistent seal and more comfort to the wearer.

In general, as packing factor increases, compliance decreases, but is still higher than a conventional headphone. In one example, a headphone having an ear cup with a plurality of sound absorbing segments and having a packing factor of 50% was found to be 71% more compliant than a conventional headphone; a headphone having an ear cup with a plurality of sound absorbing segments and having a packing factor of 75% was found to be 46% more compliant than a conventional headphone; a headphone having an ear cup with a plurality of sound absorbing segments and having a packing factor of 90% was found to be 28% more compliant than a conventional headphone; and a headphone having an ear cup with a plurality of sound absorbing segments and having a packing factor of 100% was found to be 27% more compliant than a conventional headphone.

A number of implementations have been described. Nevertheless, it will be understood that the foregoing description is intended to illustrate and not to limit the scope of the inventive concepts which are defined by the scope of the claims. Other examples are within the scope of the following claims.

What is claimed is:

1. A headphone, comprising:

at least one cushion constructed and arranged for contact with a wearer, the at least one cushion comprising an interior region;

an electro-acoustical driver that transmits a sound towards an ear canal of the wearer of the headphone; and a plurality of standalone segments comprising exclusively unstructured pieces of a sound absorbing foam material that at least partially fill the interior region of the cushion, the interior region including air pockets between neighboring unstructured pieces of the sound absorbing foam material, wherein the segments provide greater acoustic damping over a range of frequencies when compared to a reference single piece of sound absorbing material filling the cushion.

2. The headphone of claim 1, wherein the sound absorbing segments are at least one of: cube, sphere, or rectangular shaped.

3. The headphone of claim 1, wherein the foam material comprises a partially reticulated foam structure.

4. The headphone of claim 1, wherein the foam material comprises polyurethane.

5. The headphone of claim 1, further comprising a cushion covering constructed and arranged for covering the interior region of the cushion, and for maintaining the segments in the interior region.

6. The headphone of claim 1, wherein the interior region includes a passageway formed in front of the electro-acoustical driver and surrounded by an arrangement of the segments so as to form an acoustical path from the driver to the ear canal when the headphone is worn.

7. The headphone of claim 1, wherein the segments provide greater mechanical compliance when compared to the reference single piece of sound absorbing material.

8. The headphone of claim 1, wherein a packing factor of the segments that at least partially fill the interior region of the cushion is less than that of the reference single piece of sound absorbing material that at least partially fills the interior region of the cushion.

9. The headphone of claim 1, wherein a ratio of an aggregate of the segments' surface area relative to a volume of the aggregate of the segments in the cushion is increased compared to the same ratio in the cushion including the reference single piece of sound absorbing material.

10. The headphone of claim 1, further comprises an ear cup coupled to the cushion, the driver positioned between the ear cup and the cushion.

11. The headphone of claim 1, wherein the segments provide an acoustic damping characteristic over a range of frequencies that is tuned according to a configuration of the air pockets between the segments.

12. An earpiece unit, comprising:

an ear cup;

a cushion coupled to the ear cup, and constructed and arranged for contact with a wearer;

a plurality of standalone segments comprising exclusively unstructured pieces of a sound absorbing foam material that at least partially fill the interior region of the cushion skin, the interior region including air pockets between neighboring unstructured pieces of the sound absorbing foam material, wherein the segments provide greater acoustic damping over a range of frequencies when compared to a reference single piece of sound absorbing material filling the cushion; and an electro-acoustical driver between the ear cup and the cushion, the driver transmitting a sound towards an ear canal of the wearer of the headphone.

13. The earpiece unit of claim 12, wherein the sound absorbing segments are at least one of: cube, sphere, or rectangular shaped.

14. The earpiece unit of claim 12, wherein the sound absorbing material comprises a foam material.

15. The earpiece unit of claim 12, wherein the interior region includes a passageway formed in front of the electro-acoustical driver and surrounded by an arrangement of the segments so as to form an acoustical path from the driver to the ear canal when the headphone is worn.

16. The earpiece unit of claim 12, wherein the segments provide greater compliance when compared to the reference single piece of sound absorbing material.

17. The earpiece unit of claim 12, wherein a packing factor of the segments that at least partially fill the interior region of the cushion is less than that of the reference single piece of sound absorbing material that at least partially fills the interior region of the cushion.

18. The earpiece unit of claim 12, wherein a ratio of an aggregate of the segments' surface area relative to a volume of the aggregate of the segments in the cushion is increased compared to the same ratio in the cushion including the reference single piece of sound absorbing material.

19. The earpiece unit of claim 12, wherein the segments provide an acoustic damping characteristic over a range of frequencies that is tuned according to a configuration of the air pockets between the segments.

20. A headphone, comprising:

at least one cushion constructed and arranged for contact with a wearer, the at least one cushion comprising an interior region;

an electro-acoustical driver that transmits a sound towards an ear canal of the wearer of the headphone; and a plurality of standalone segments comprising exclusively unstructured pieces of a sound absorbing foam material that at least partially fill the interior region of the cushion, the interior region including air pockets between neighboring unstructured pieces of the sound absorbing foam material, wherein the air pockets provide additional paths for air molecules to penetrate the foam segments for modifying an acoustical characteristic of the at least one cushion, and wherein the number of air pockets in the interior region of the cushion depends on an amount of the interior region of the cushion filled by the unstructured pieces of a sound absorbing foam material.

* * * * *